US005214834A

United States Patent [19]

Froment

[11] Patent Number: 5,214,834

[45] Date of Patent: Jun. 1, 1993

[54] PROCESS FOR ASSEMBLING THE ACTUATION ELEMENTS OF A ROTATING DOBBY

[75] Inventor: Jean-Paul Froment, Doussard, France

[73] Assignee: S.A. des Etablissments Staubli, Faverges, France

[21] Appl. No.: 824,781

[22] Filed: Jan. 15, 1992

Related U.S. Application Data

[62] Division of Ser. No. 694,376, May 1, 1991, Pat. No. 5,125,434.

[30] Foreign Application Priority Data

May 18, 1990 [FR] France ..... 90 06497

[51] Int. Cl.[5] ..... B23P 11/00

[52] U.S. Cl. ..... 29/434; 139/66 R

[58] Field of Search ..... 29/434, 428; 139/66 R, 139/71, 76

[56] References Cited

U.S. PATENT DOCUMENTS

| | | | |
|---|---|---|---|
| 4,387,741 | 6/1983 | Palau et al. | 139/66 R |
| 4,404,993 | 9/1983 | Julich et al. | 139/66 R |
| 4,444,225 | 4/1984 | Palau et al. | 139/66 R |
| 4,643,231 | 2/1987 | Brock et al. | 139/66 R |

FOREIGN PATENT DOCUMENTS 2596425 2/1987 France .

*Primary Examiner*—Mark Rosenbaum
*Assistant Examiner*—S. Thomas Hughes
*Attorney, Agent, or Firm*—Dowell & Dowell

[57] ABSTRACT

A process for assembling the actuation elements of a rotating dobby, in which the connection between the driver plates of the different actuation elements and the driven shaft thereof is effected by axial tightening of the driver plates between an end cap and spaced bearings. Such tightening is effected once the drawing levers have been engaged on the pivot pin so that the members of each actuation element, which are selectively connected to one another by the coupling elements, are automatically properly positioned on the drive shaft.

1 Claim, 5 Drawing Sheets

39
27
38
25a
A
26
25
33
31
31a
29
29b
30
32
29c
30a
29a
29b
35a
34a
36
35
34
34a
24

34a 46
34b
24
34

PROCESS FOR ASSEMBLING THE ACTUATION ELEMENTS OF A ROTATING DOBBY

This application is a division of U.S. patent application Ser. No. 07/694,376, filed May 1, 1991, now U.S. Pat. No. 5,125,434.

BACKGROUND OF THE INVENTION

1. Field of the Invention

The present invention relates to a process for assembling the actuation elements of a rotating dobby.

2. History of the Related Art

Rotating dobbies for forming the shed in weaving looms are known to be constituted by the assembly, side by side, along a principal shaft driven in an intermittent movement of rotation with a stop every 180°, of a series of actuation elements which are placed under the control of a programmed reading device and of which each is connected to one of the heddle frames mounted on the corresponding loom.

The invention relates more particularly to rotating dobbies of the type disclosed in French Patent No. 2 596 425 of Mar. 26, 1986 to STAUBLI. As schematically shown in FIG. 1 of the accompanying drawings, which figure reproduces FIG. 1 of the Patent in question, the frame 1 supports the intermittently rotating principal shaft 2 which drives the actuation elements of the dobby. Each elements includes a connecting rod 3 coupled to a lever 4 connected to one of the frames 5 of the loom. Each connecting rod 3 has an opening therein in which is engaged, with the interposition of a roller bearing 6, an eccentric 7 mounted idly on shaft 2 via a roller bearing 8. In addition, there is associated with each connecting rod 3 a driver plate 9 which is secured to the shaft 2, provided to the splined to that end, and which has two opposite notches 9*a* therein, adapted to cooperate with a coupling hook 10 mounted on a small pin 11 carried by a projecting plate secured to the eccentric 7.

Pivoting of the hook against its return spring 12 is controlled by two selector levers 13 which pivot at 14 and which are coupled to one another by a small rod 15. With one of these levers 13 are associated two pivoting rods 16 that needles 17, placed under the control of a programmed reading device 18, conduct to a position such that the rods are or are not placed opposite the reciprocating stroke of two pushers 19. There is associated with one of the levers 13 a spring 20 which tends to maintain the opposite lever in abutment against a fixed stop 21.

When the hook 10 is subjected to the action of its spring 12, the eccentric 7 is coupled to shaft 2, with the result that the connecting rod 3 is pivoted by an oscillating movement which displaces the frame 5 vertically. On the contrary, when this hook receives the action of one of the levers 13, its outer edge comes into contact with a resiliently urged bolt 22 carried by a small fixed pin 23, with the result that it is immobilized and that it in turn immobilizes the connecting rod 3 shown.

In principle, such an arrangement makes it possible to obtain reliable functioning even at high speeds of rotation, but this advantageous result is obtained only with a drastic monitoring of the different elements constituting the actuation elements, this, in addition, involving very meticulous assembly operations. It will be readily appreciated that even the slightest defect in the positioning of the pivot pins 11 (hook 10) and 23 (bolts 22) or in the profile of the notches made in the plates 9 and in the back of the hook mentioned, automatically make correct functioning impossible.

It is a principal object of the present invention to overcome this drawback in conventional rotating dobbies.

SUMMARY OF THE INVENTION

The invention relates to a process for assembling the actuation elements of a rotating dobby, which process consists principally in mutually positioning the members of each of the actuation elements, so as to cause cooperation between a control hook or engaging element and the drive plate which is mounted on the drive shaft and between another engaging element which selectively connects an eccentric to a connecting rod. Thereafter, the assembly of elements is engaged on the principal drive shaft with their orientation thereon being aided by the connection of the connecting rods to the drawing lever which connects each connecting rod to the corresponding heddle frame. Finally, an axial tightening along the axis of the drive shaft is accomplished so that the driving plates, gripped between roller bearings of the eccentrics, are rigidly secured to the drive shaft.

It will be understood that such a process of assembly automatically overcomes all the faults likely to affect the positioning or profile of the members constituting the actuation elements

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 2:
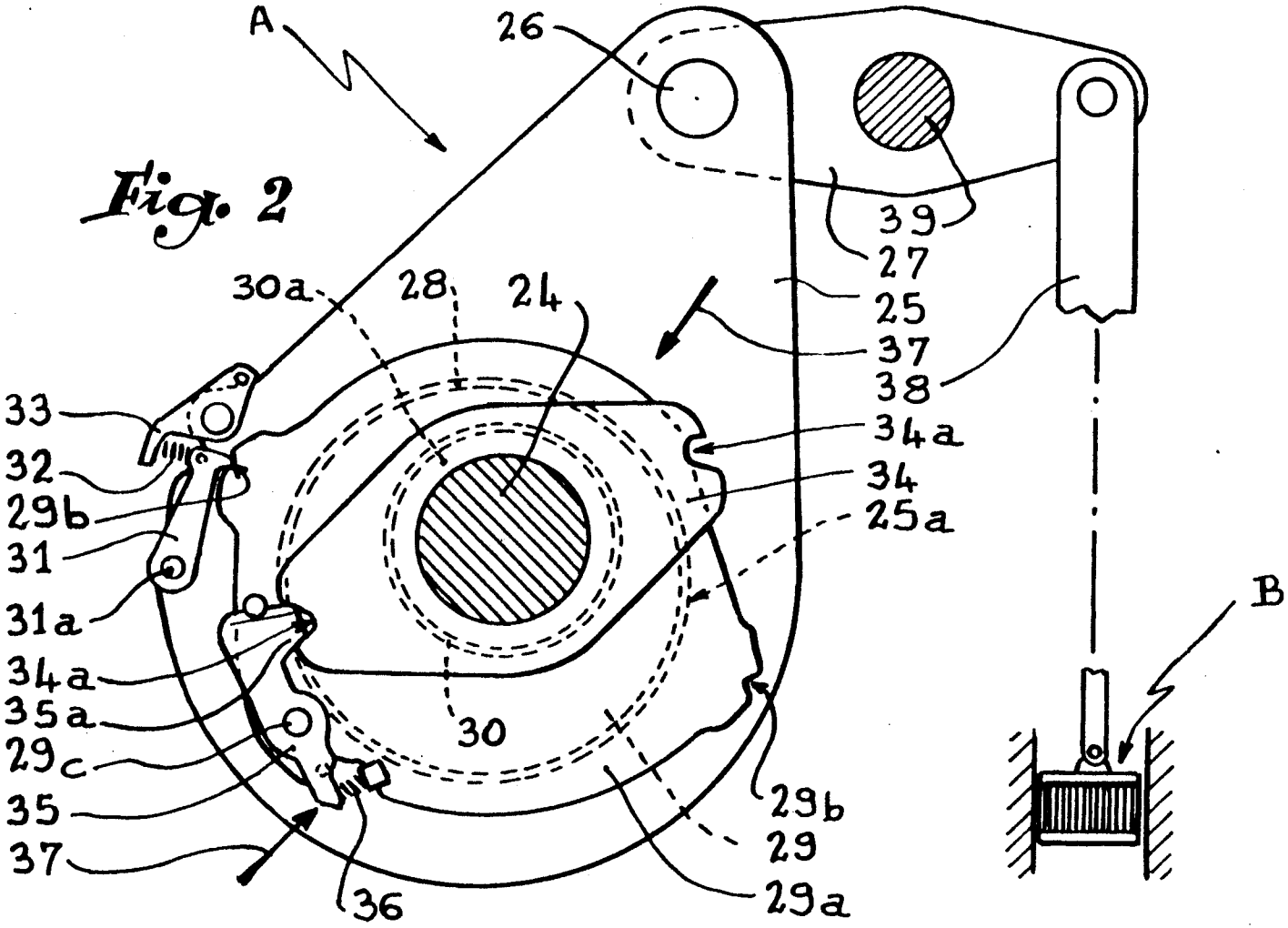
FIG. 2 a schematic transverse section through a rotating dobby according to the invention, this section showing the arrangement of each of the actuation elements mounted on the principal shaft.

Referring again to the drawings, in FIG. 2, reference 24 designates the principal shaft of the dobby, which, while being driven by an intermittent movement of rotation with a stop every 180°, has a smooth wall. On shaft 24 are fitted the different actuation elements "A" of the dobby placed under the control of a reading device containing the weaving program for controlling the heddle frame "B" coupled to the elements.

As shown more particularly in FIG. 2, each element "A" compromises a connecting rod 25 of substantially triangular profile, of which the apex carries a pin 26 on which is articulated the end of a lever 27 which will be described hereinafter. The connecting rod 25 has a circular opening 25*a* therein (cf. FIG. 3) inside which is engaged, with the interposition of a roller bearing 28, an eccentric 29 mounted idly on the shaft 24 with the interposition of a roller bearing 30. The eccentric 29 is laterally secured to a plate 29a of which the suitably profiled outer edge has two diametrically opposite notches 29b therein.

Notches 29b are adapted to cooperate with the tip of a bolt 31 of which the base is provided with a lateral pivot pin 31a freely introduced in a performation made in the connecting rod 25, in the immediate vicinity of the edge thereof. A spring 32, abutting against a stop 33 mounted against the connecting rod 25, tends to urge the pivoting bolt 31 so that is tip engages in one or the other of the two notches 29b, resiliently ensuring the angular immobilization of the connecting rod 25 with respect to the eccentric 29 and vice versa.

Each actuation element "A" further comprises a driver plate 34 of which the periphery has two diametrically opposite notches 34a therein. With this driver plate 34 there is associated a pivoting hook 35 mounted on a lateral pin 29c extending from the plate 29a of the eccentric 29. A spring 36, bearing on a stop of the plate 29a, tends to engaged the norse or tip 35a of the hook 25 inside one or the other of the two notches 34a of the driver plate 34, which is thus positioned angularly with respect to the eccentric 29 at that same time as it is retained fixed relative thereto.

Figure 1:
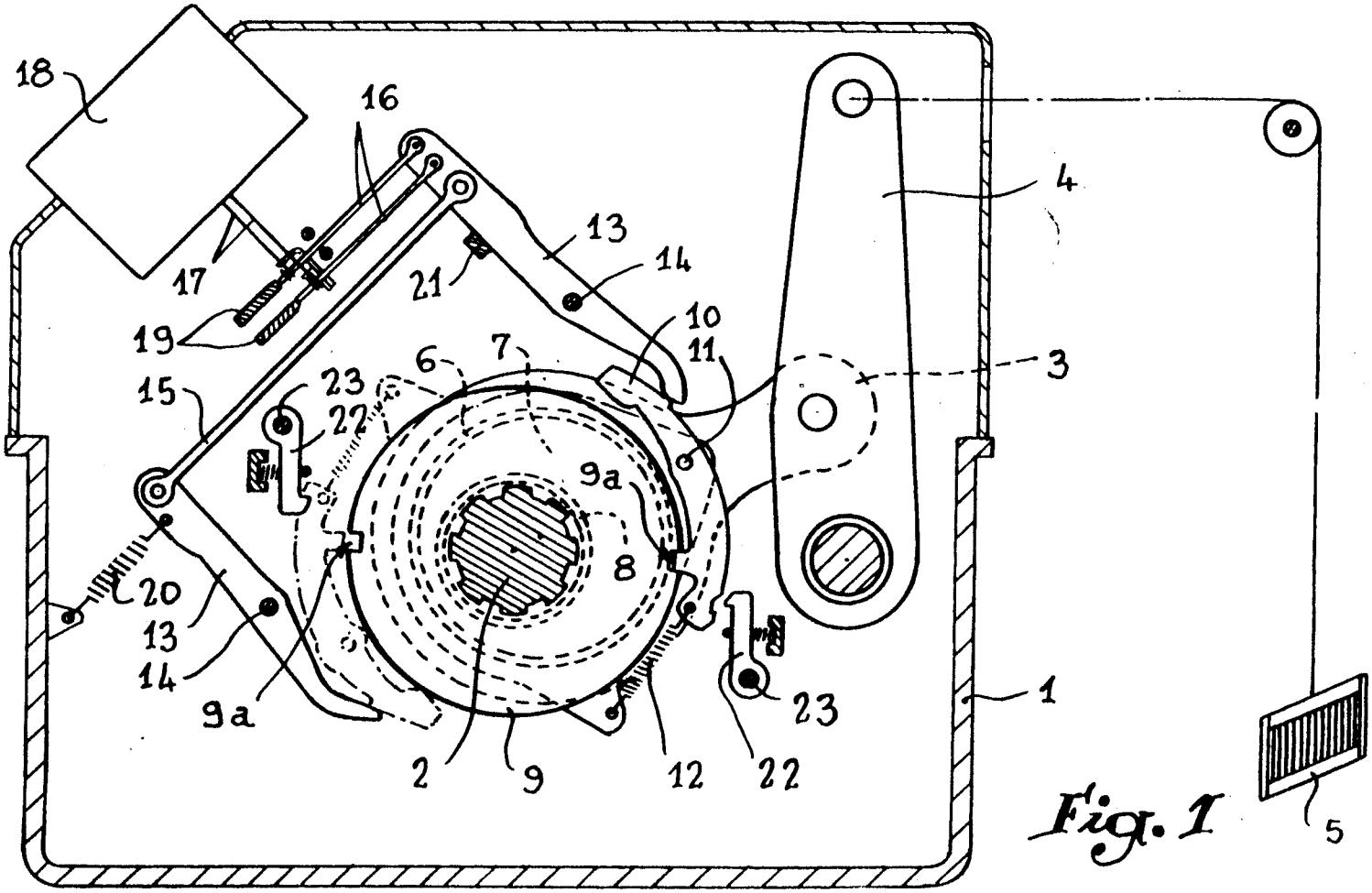
Fig. 1 PRIOR ART
FIG. 1, as indicated hereinbefore, shows the arrangement of a known rotating dobby.

Control of the pivoting hook 35 against its spring 36 is effected by one or the other of two selector levers which have been schematically shown by arrows 37 in FIG. 2 but which are, in fact, similar to the two levers 13 of FIG. 1, being subjected to a programmed reading device. In addition, the functioning of the dobby is identical to that of the dobby of FIG. 1 and therefore requires n detailed description.

It will be noted that, according to the invention, the assembly of the levers 27, which are coupled to the connecting rods 25, and to tie-rods 38 connected to the heddle frames "B" are articulated on a fixed pin 39 (FIG. 2) carried by the frame of the dobby parallel to shaft 24.

Figure 4:
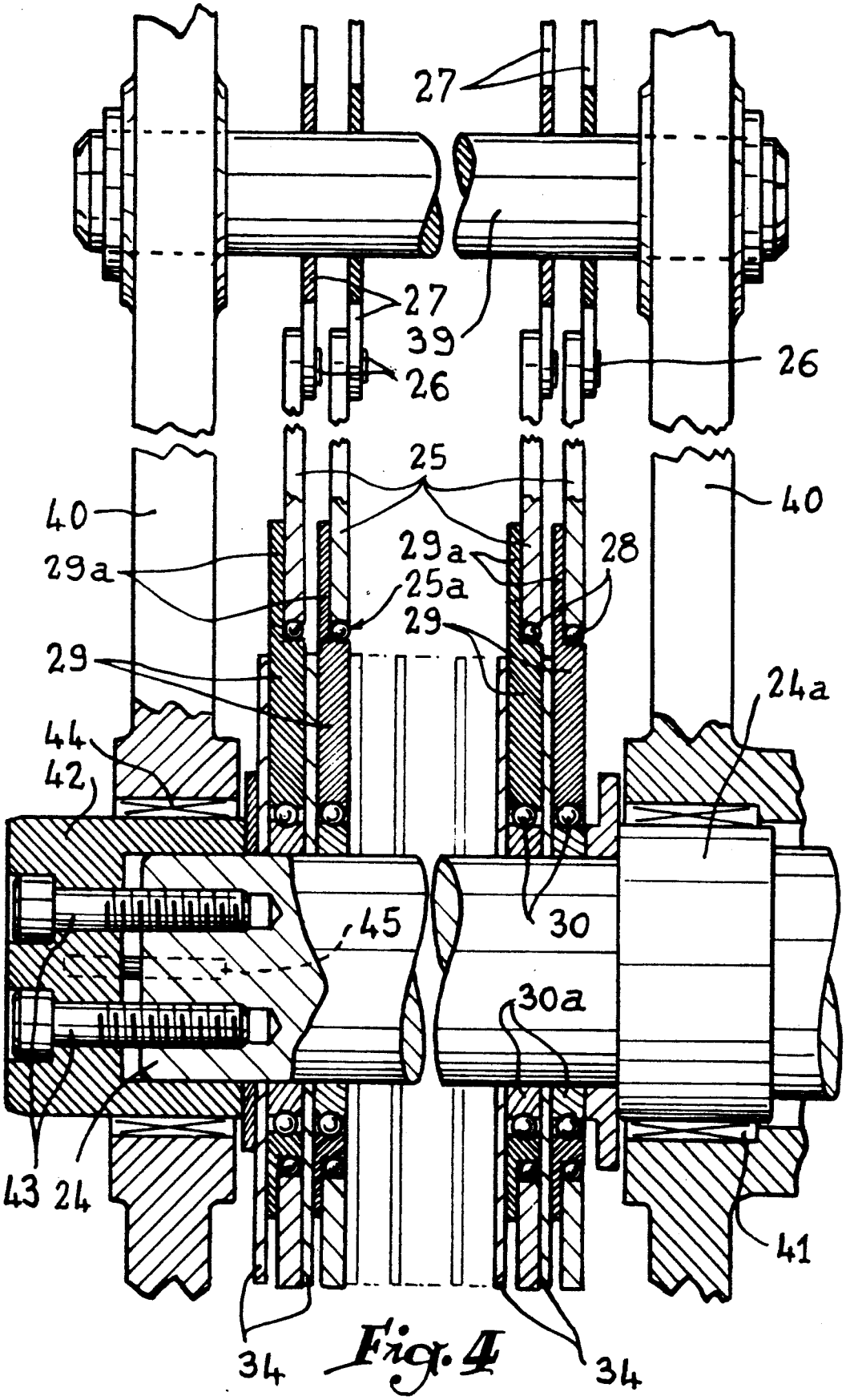
FIG. 4 is a axial section through the dobby.

FIG. 4 clearly shows the parallel assembly of shaft 24 and the pivot pin 39 between the two side plates 40 which form the frame mentioned above. One of these plates is equipped with a needle bearing 41 inside which is supported shoulder 24a of the shaft 24. It will be understood that the actuation elements "A" of the dobby are capable of being engaged on the shaft 24 by the roller bearings 30 and the driver plates 34 at the same time as the levers 27 are introduced on the pin 39. (In another embodiment, pin 39 may be introduced in the assembly of the actuation elements once the elements are on the shaft 24).

Such engagement on shaft and pin elements 24 and 39 ensures both suitable orientation of the elements "A" with respect to shaft 24 and to the heddle frames "B", and perfect positioning of the members constituting each element, since the driver plate 34 is connected by the hook 35 to the eccentric 29 which is itself connected to the connecting rod 25 by the bolt 31.

Figure 5:
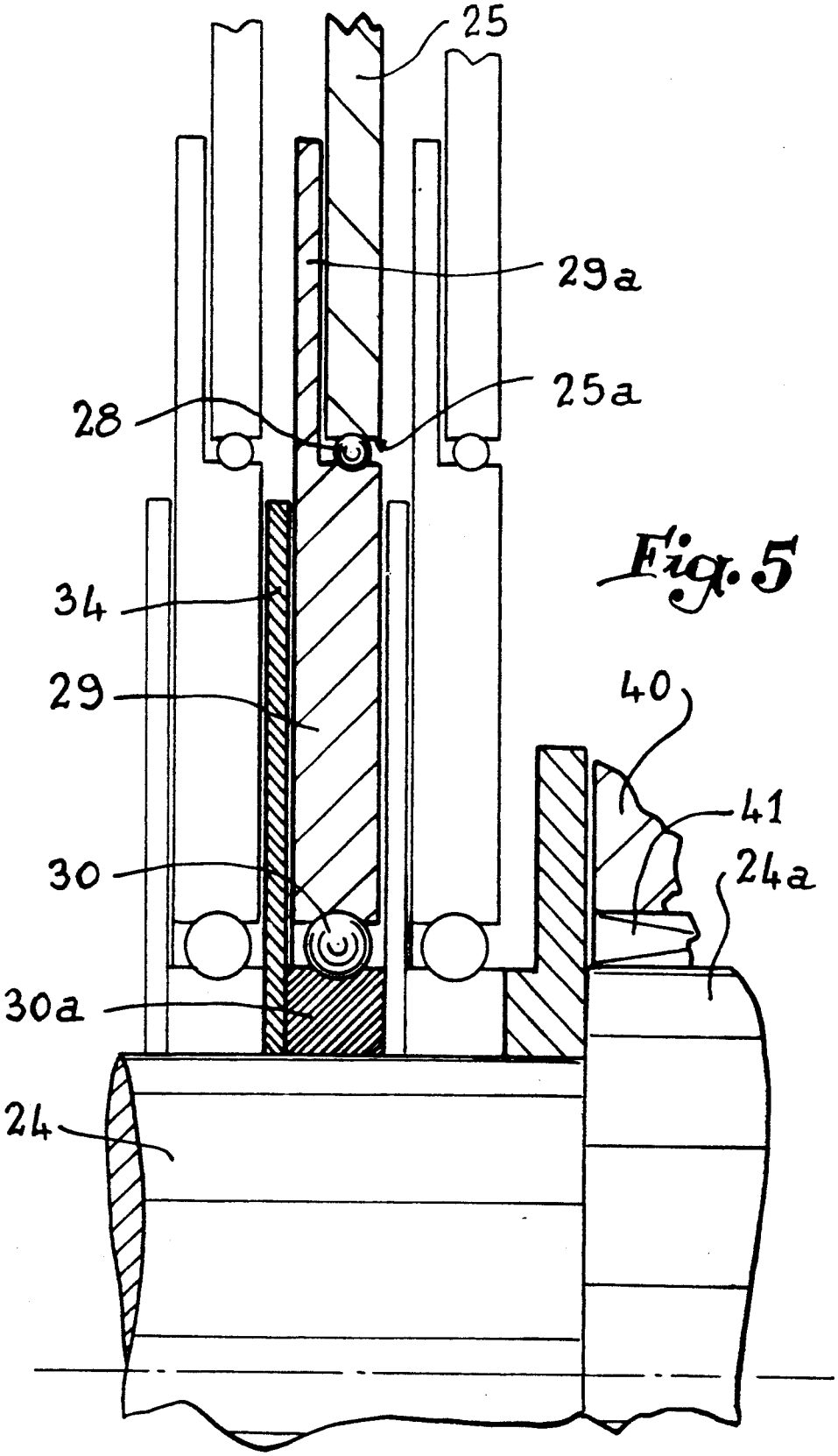
FIG. 5 reproduces a detail of FIG. 4, on a larger scale.

It then suffices to engage, on the end of the shaft 24 opposite the end supported by roller bearing 41, a cap 42 equipped with longitudinal screws 43 cooperating with corresponding tappings in shaft 24, and to tighten the screws 43. It will be understood that, if care has been taken to give the inner ring 30a of the roller bearings 30 an axial thickness slightly greater than that of the assembly formed by each eccentric 29 and its plate 29a, adjusting the screws 43 ensures, by application of the free edge of the cap 42 against the element "A" or an appropriate bearing washer, the efficient connection of the shaft 24 and the driver plates 34. The plates are gripped between the roller bearings 30, while the eccentrics 29 remain free to rotate, all this being clearly illustrated in FIG. 5.

The tightening cap 42 is supported by the corresponding side plate 40 of the dobby with the aid of a needle bearing such as the one shown at 44 in FIG. 4. A longitudinal pin 45 is provided between cap 42 and the shaft 24 so as to avoid any risk of rotational shifting between the two pieces.

Figures 3, 6:
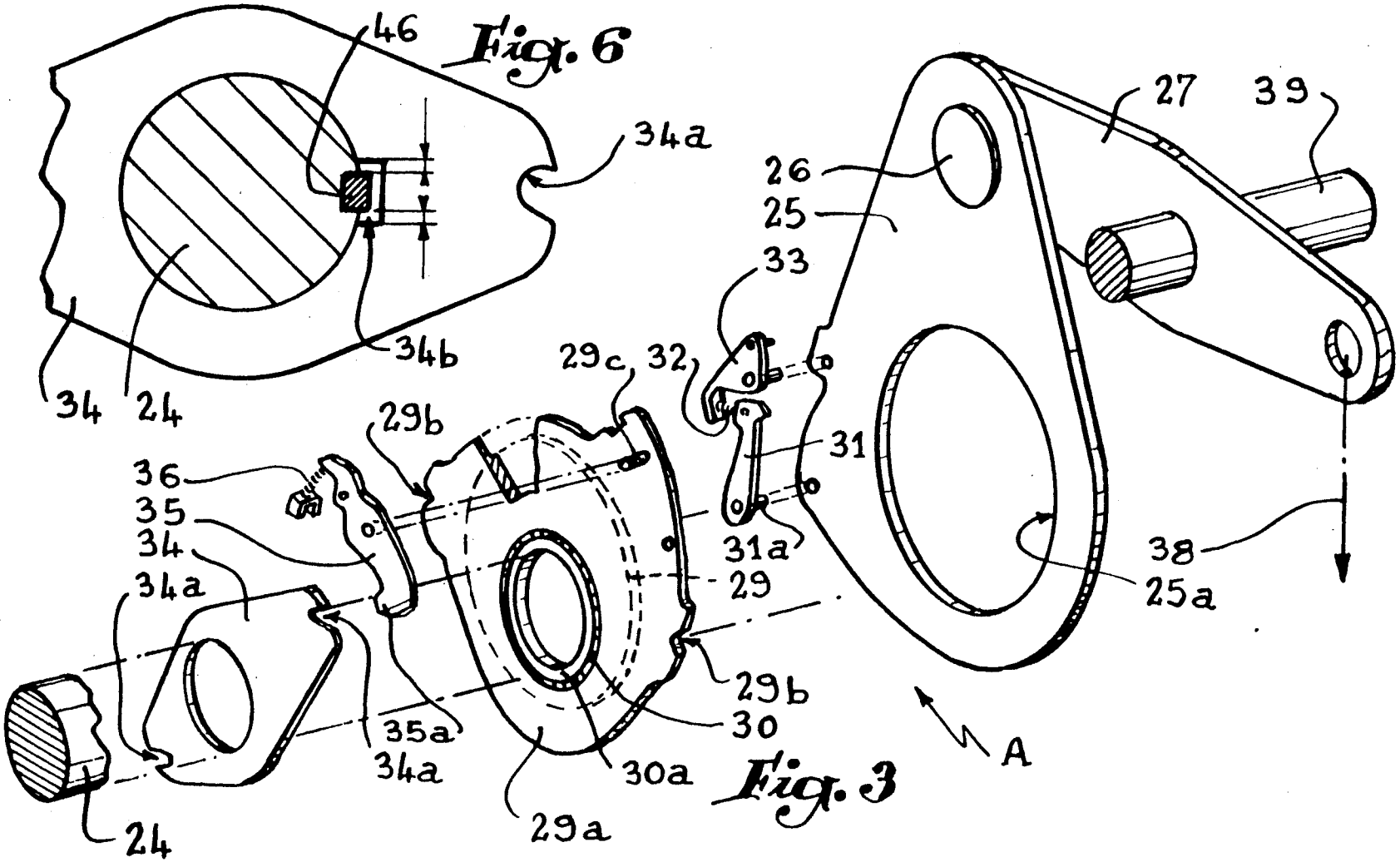
FIG. 3 is a perspective view illustrating the reciprocal angular positioning of the members which constitute the same actuation element.
FIG. 6 illustrates an alternate embodiment of the invention.

In certain cases and in the manner illustrated in FIG. 6, the shaft 24 may be provided with a longitudinal key 46 adapted to oppose a considerable rotational shift of the driver plates 34 in case of defective tightening of the cap 42. The key 46 allow a clearance inside a notch 34b made in the opening of each plate in order to allow self-adjustment thereof during initial assembly.

What is claimed is:

1. A process for assembling the actuation elements of a rotating dobby wherein each element includes a driver plate which is adapted to be mounted on an intermittently driven principal drive shaft and which is selectively connected by a first engaging means controlled by a reading device to an eccentric which is mounted on a bearing means to the principal drive shaft and which is also selectively connected to a connecting rod by way of a second engaging means and wherein the connecting rod is coupled through a drawing lever to a heddle frame in a weaving loom, said process comprising the steps of:

a) mutually positioning each of the actuation elements on the principal drive shaft and engaging each first engaging means with its corresponding driver plate and engaging each second engaging means with its corresponding eccentric;

b) aligning the actuation elements on the principal drive shaft in side-by-side relationship by pivotally connecting each connecting rod with a drawing lever which extends between each connecting rod and its corresponding heddle frame; and c) exerting an axial tightening force along the principal drive shaft, thereby gripping the driver plates between the bearing means and securing the driver plates to the principal drive shaft while allowing the eccentrics to be rotatable with respect to the principal drive shaft.

* * * * *